US005233335A

United States Patent [19]

Berwin

[11] Patent Number: 5,233,335

[45] Date of Patent: Aug. 3, 1993

[54] SYMBOL/RASTER GENERATOR FOR CRT DISPLAY

[75] Inventor: Ted W. Berwin, Playa del Rey, Calif.

[73] Assignee: Hughes Aircraft Company, Los Angeles, Calif.

[21] Appl. No.: 369,980

[22] Filed: Jun. 22, 1989

[51] Int. Cl.[5] ..... G09G 1/10; G09G 1/14

[52] U.S. Cl. ..... 340/739; 340/747; 340/748

[58] Field of Search ..... 340/739, 740, 741, 742, 340/743, 727, 732; 358/140; 364/729, 731, 742, 521

[56] References Cited

U.S. PATENT DOCUMENTS

| | | | |
|---|---|---|---|
| 3,755,805 | 8/1973 | Dandrel et al. | 340/739 |
| 4,115,863 | 9/1978 | Brown | 364/521 |
| 4,228,432 | 10/1980 | Osborne | 340/739 |
| 4,228,510 | 10/1980 | Johnson et al. | 340/727 |
| 4,311,998 | 1/1982 | Matherat | 340/739 |
| 4,384,286 | 5/1983 | DiToro | 364/742 |
| 4,507,656 | 3/1985 | Morey et al. | 340/739 |
| 4,553,214 | 11/1985 | Dettmer | 340/739 |
| 4,656,467 | 4/1987 | Strolle | 340/727 |
| 4,746,916 | 5/1988 | Sanbe | 340/731 |

*Primary Examiner*—Alvin E. Oberley
*Assistant Examiner*—Steven J. Saras
*Attorney, Agent, or Firm*—L. A. Alkov; W. K. Denson-Low

[57] ABSTRACT

A symbol/raster generator system for a CRT display system is described, having the capability of generating raster-scanned display signals or vector symbology. The system includes a polar coordinate transformation circuit which transforms polar coordinate beam deflection data into corresponding X and Y beam deflection control signals. The system includes an angle accumulator for accumulating incremental angular data over time, and sine and cosine PROMS for providing the sine and cosine of the accumulated angle value. X and Y multiplier circuits provide respective incremental dX and dY values corresponding to the respective products of the cosine and sine values with a step size value dR. The incremental dX and dY values are accumulated over time to provide the X and Y beam deflection signals. The system further includes circuits for providing the angle data and step size dR so as to generate rasters, 8 and 16-side characters, curved and slanted characters, conic symbology, and other types of special symbols. The rasters can be arc-scanned rasters as required in radar displays, e.g., plan position indicator (PPI), SAR, angular and radial scan. The system provides an integrated and highly versatile raster/symbol generator for CRT displays.

15 Claims, 9 Drawing Sheets

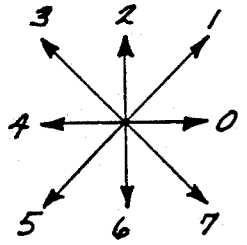
FIG.9A
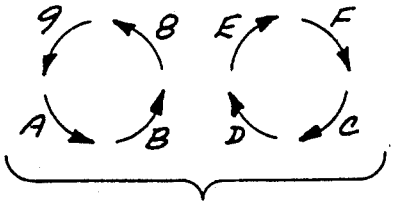
FIG.9B
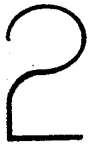
FIG.9C
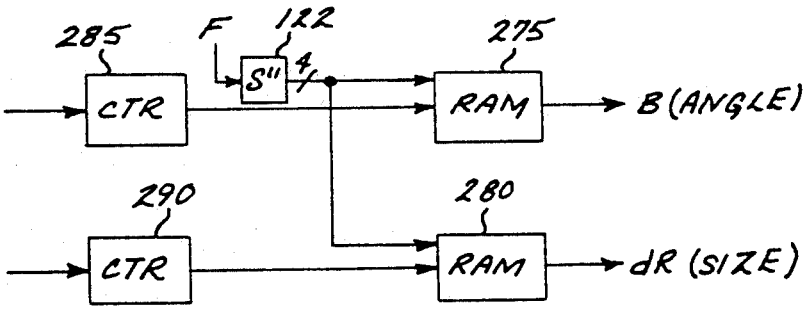
FIG.9D
FIG.9E
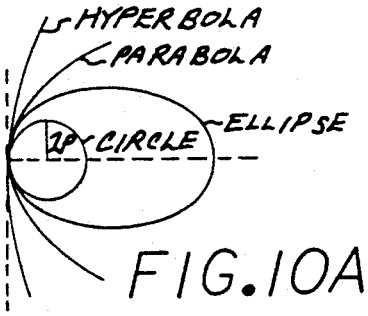
FIG.10A
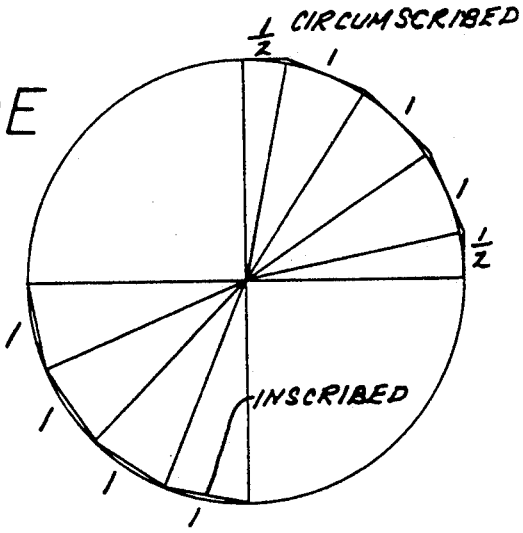
FIG.10B
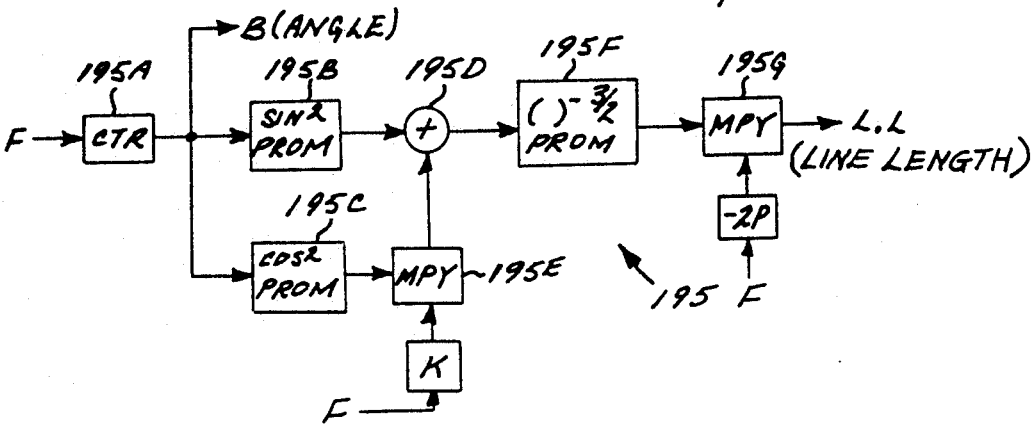

FIG. 11
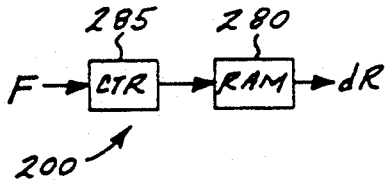
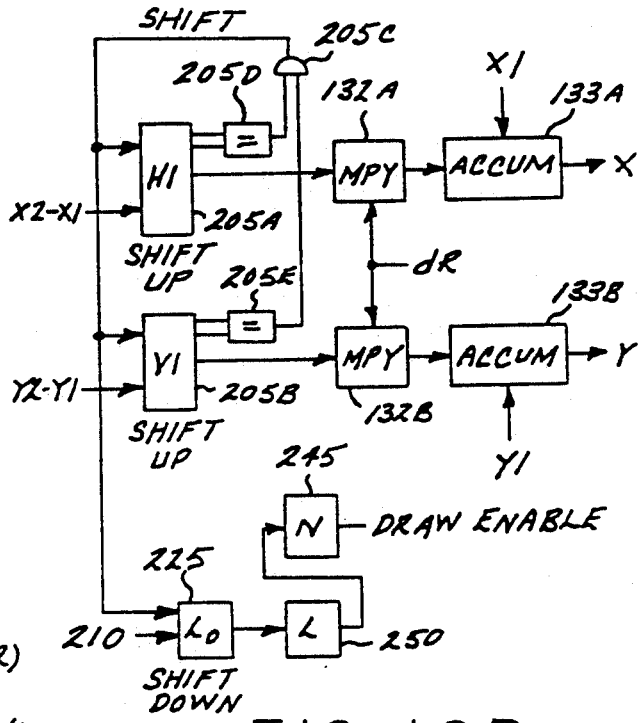
FIG. 12B
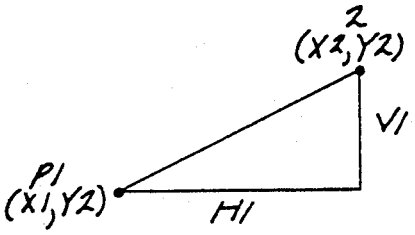
FIG. 12A
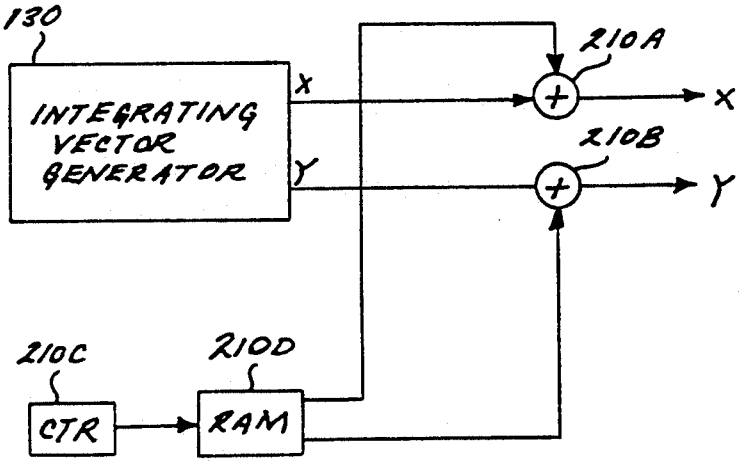
FIG. 13

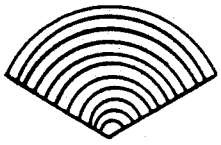
FIG. 16A (PPI)
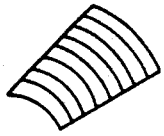
FIG. 16B (DBS PATCH)
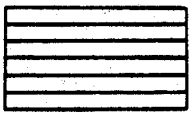
FIG. 16C (STANDARD TV)
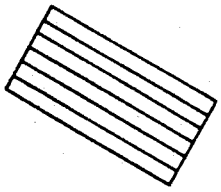
FIG. 16D (ROTATED TV)
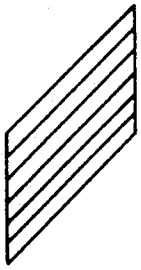
FIG. 16E (SAR PATCH)

SYMBOL/RASTER GENERATOR FOR CRT DISPLAY

BACKGROUND OF THE INVENTION

The present invention relates to cathode ray tube (CRT) displays, and more particularly to an apparatus for generating either stroke mode symbols or raster displays on a CRT or flat panel display.

Raster scan CRT displays are one well-known type of display. In a raster display, the beam is driven through a predetermined set of lines according to a particular sweep rate and refresh rate to provide substantially complete beam coverage for a particular area. The beam is turned on or off or its intensity modulated at particular pixels to create a particular image.

Another well known type of CRT display is the stroke mode display. In such a display, the X and Y beam deflection amplifiers are independently driven or controlled so as to draw a particular line or symbol. Thus, the beam is driven along only those paths in which the beam is to be turned on; complete beam coverage of an entire area per frame is not obtained.

In some applications, it is desirable to use the capability of both raster and stroke mode displays. One particular application is that of aircraft cockpit displays. Such displays may be used in one mode wherein raster imagery is used such as the display of radar data, and in another mode wherein stroke mode symbology is displayed. Some military fighter aircraft have used CRT display systems which provide the capability of both raster and stroke modes. These known systems have employed separate raster scan generators and stroke mode generators, and switch select the particular generator as desired. One disadvantage of these displays which employ separate generators is the additional circuitry required to implement such devices, which cannot only be expensive to manufacture, but consume substantial space and electrical power in the aircraft, and add substantially to the weight of the aircraft.

It is therefore an object of this invention to provide a symbol/raster generator for a CRT display which is space, weight and power efficient.

Another object of the invention is to provide a CRT controller which is operable in either a stroke or raster mode to produce either a raster scanned display or stroke mode symbology.

SUMMARY OF THE INVENTION

A symbol/raster generator system for CRT displays is disclosed and includes an integrating vector generator circuit, comprising means for transforming polar coordinate beam deflection data dA and dR into corresponding X and Y deflection control signals which may be used to control the X and Y beam deflection amplifier circuitry. The integrating vector generator circuit includes initializing means for initializing the beam position to a desired start point, and for initializing the polar angular position to a desired initial orientation. Angle converting means are provided for converting the angle value into corresponding sine and cosine values. X and Y multipliers are provided to multiply the step size dR by the respective sine and cosine values to provide dX and dY values corresponding to polar coordinate data A and dR. X and Y accumulators are provided to integrate the respective dX and dY values (with the respective initial X and Y positions) to provide the X and Y beam deflection control signals.

The symbol/raster generator with the integrating vector generator can be employed to generate various types of rasters and special symbols. An arc raster circuit is provided to generate angle data fed to the integrating vector generator to generate various linear and arc raster signals. The arc raster circuit includes an angle accumulator circuit for accumulating the incremental angle data (and the initial angle data) over a given number of clock cycles to provide an accumulated angle value to the integrating vector generator.

The system further comprises means for generating characters employing either 8 or 16 different vector directions, slanted characters, curved characters, and conic and spiral curves. The system further comprises means for generating a straight line given the line end points, and means for causing the generated symbology to drift.

BRIEF DESCRIPTION OF THE DRAWINGS

These and other features and advantages of the present invention will become more apparent from the following detailed description of an exemplary embodiment thereof, as illustrated in the accompanying drawings, in which:

FIGS. 9A–9E illustrate the curved character generator circuit comprising the system of FIG. 3.

FIGS. 10A–10B illustrates the conic curve generator circuit comprising the system of FIG. 3.

FIG. 11 illustrates the spiral curve generator circuit comprising the system of FIG. 3.

FIGS. 12A–B illustrate the end points line generating circuit comprising the system of FIG. 3.

FIG. 13 illustrates the drift circuit comprising the system of FIG. 3.

FIGS. 16A–E illustrate several rasters which may be generated using the system of FIG. 3.

DETAILED DESCRIPTION OF THE PREFERRED EMBODIMENTS

Overview of the Invention

Figure 1:
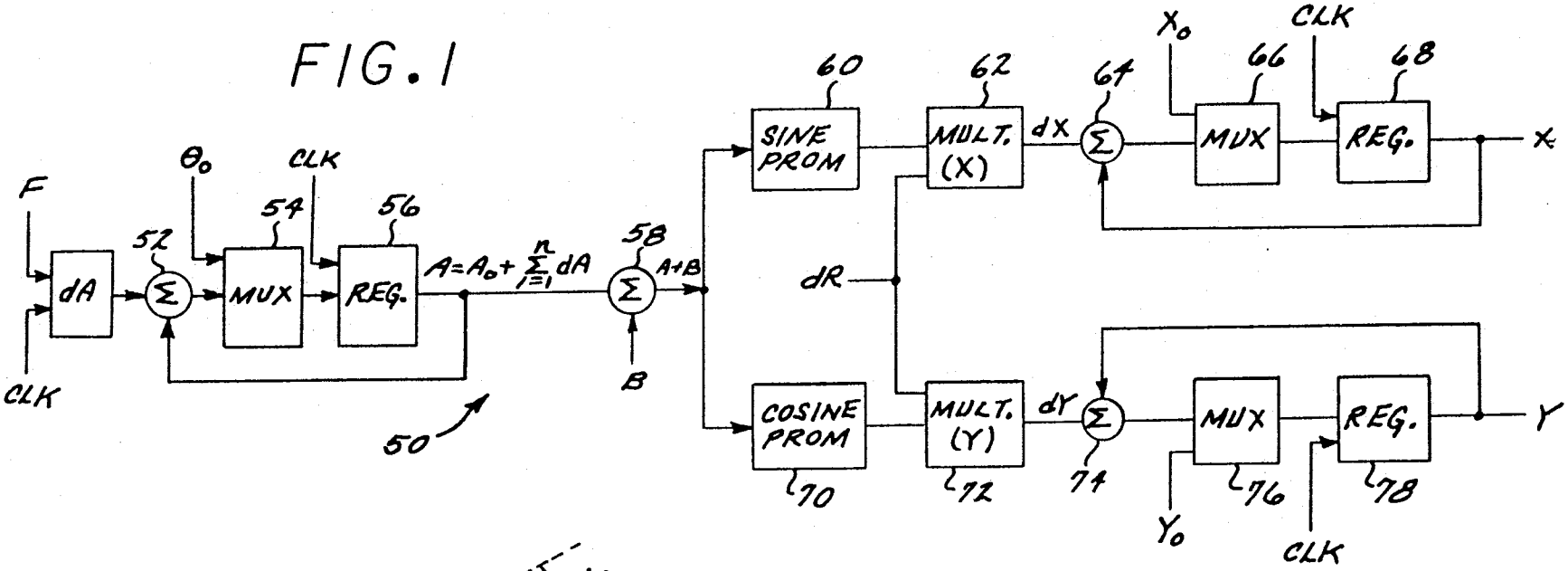
FIG. 1 is a block diagram of a raster/symbol generator embodying the invention.

The invention is illustrated in the simplified digital block diagram of FIG. 1. The apparatus 50 comprises digital angle accumulator 52 which sums the incremental input angle signal dA with a feedback angle signal to provide an accumulated value. The accumulated angle signal is multiplexed with an initial angle value $A_o$ by multiplexer 54. The multiplexer output is fed to register 56, and the clocked output of the register is fed back to the accumulator 52, and represents the accumulated value $A=A_o+$(sum (i=1 to n over n clock periods)) of dA. The output of the register 56 is also fed to summer 58 for summing with the rotational angle data B to provide a composite angle signal at the output of the summer 58.

The composite angle signal is in digital form, e.g., a 16 bit number, and is fed as addressing input signals to the sine and cosine PROMs 70 and 60. These PROMs function as lookup tables to convert the composite angle signal value into signals representing the sine and cosine of the composite angle signal value, respectively. The cosine value is fed to the X channel of the generator 50, and the sine value is fed to the Y channel.

The X channel comprises a digital multiplier 62 for multiplying the cosine value with the value dR to provide the product signal cosine(A+B)dR. The product is fed to another digital accumulator circuit comprising summer 64 for summing the product with the accumulated value, X, a multiplexer 66 for selecting either the summer output or an initial value for X, and a register 68. The register output is the X channel control signal, which can be converted to an analog signal by a digital-to-analog converter (not shown in FIG. 1.) to drive the X deflection amplifier.

Similarly, the Y channel comprises a digital multiplier 72 which multiplies the sine value from PROM 70 with dR to provide the product signal sine(A+B)dR. This product is fed to another accumulator circuit comprising summer 74 for summing the product signal with the accumulated value, a multiplexer 76 for selecting either the summer output or an initial value $Y_o$ for Y, and a register 78. The register output is the Y channel control signal, which can be converted to an analog signal to drive the Y deflection amplifier.

The generator 50 operates to convert the polar coordinate data represented by the incremental values dA and dR into corresponding X and Y control signals. The values of X and Y are updated or incremented once each clock period.

Figure 2:
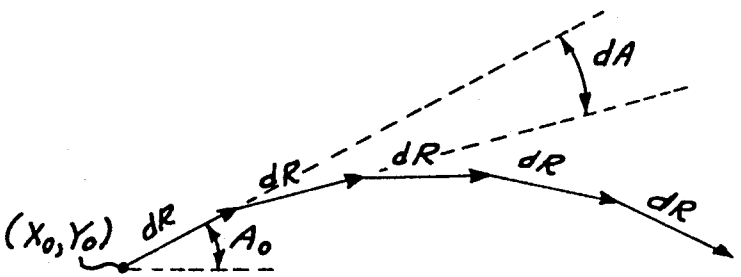
FIG. 2 is a diagram illustrative of the CRT beam deflection by signals generated by the generator of FIG. 1.

Before the first clock period, the multiplexer 54 is operated to load register 56 with the initializing value $A_o$, and the multiplexers 66 and 76 are operated to the registers 68 and 78 with the respective initializing values $X_o$ and $Y_o$. It will be apparent that if the value for dA remains constant, and the value for dR remains constant, then the accumulated angle value from the register 56 will incrementally change by dA, starting from $A_o$, each clock period; and the X and the Y signals resulting therefrom will cause the beam to be deflected through an arc of uniform radius starting from coordinates $X_o$, $Y_o$. This is illustrated in FIG. 2.

The values for dA, $A_o$, B and dR can be made programmable in a stroke mode CRT display system, so that the generator 50 can be employed to deflect the beam through any desired path defined by vectors of length dR (or some scaled version thereof) and incremental angle dA, where both dR and dA can change from clock period to clock period. The generator can be employed to generate X and Y deflection control signals for raster displays. For conventional TV or linear raster signals, dA is set to zero, and successive lines can be drawn by defining different adjacent line start coordinates $X_o$, $Y_o$. Thus, the generator 50 of FIG. 1 is a powerful raster/symbol signal generator for use in a CRT raster/stroke mode display.

The generator 50 when used in a CRT display in accordance with the invention is capable of generating an arc raster where the fast sweep is an arc, i.e., during the TV raster horizontal line time. To draw an arc raster, only dR changes from line to line. Some rasters possible are PPI, DBS patch, standard TV, rotated TV, SAR patch. In addition to generating arc rasters, symbols may be drawn with the generator embodying the invention. Some symbols possible are alphanumeric characters, circles, conics (ellipses, parabolas, hyberbolas) and general symbols made up of vectors.

The Preferred Embodiment

Figure 3:
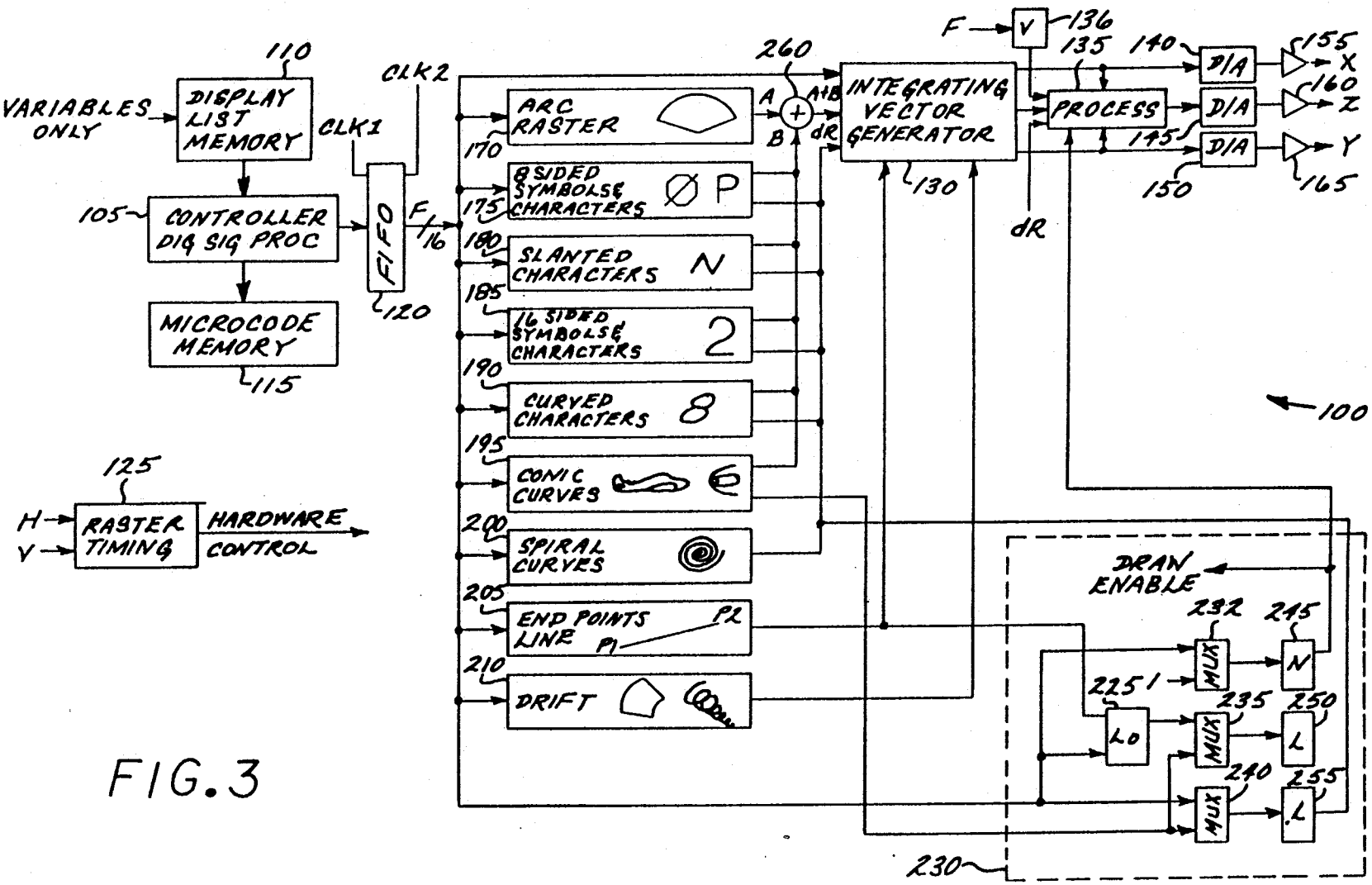
FIG. 3 is a functional block diagram illustrative of a symbol/raster generator system embodying the invention.

FIG. 3 illustrates a simplified block diagram of a symbol/raster generator system 100 embodying the invention.

Controller Section

The controller section of the system 100 comprises a display list memory 110, a digital signal processor 105, a FIFO (First-in First-out Memory) 120, and a microcode memory 115.

The system 100 hardware requires information in machine language, e.g., 16 bit data words (F) and an 8 bit destination address which is decoded providing register enable signals for the various registers and counters in the system 100.

The display list stored in memory 110 contains high level instructions, symbols, characters, and fixed parameters. Only variables from the outside world are required as input to the memory 110, e.g., positions, angles, sizes, changing text, mode changes, etc.

An instruction from the display list addresses a subroutine in the microcode memory 115 which performs a sequence of operations (using data from the display list) in the ALU (arithmetic logic unit), MPY (multiplier), and barrel shifter sections of the digital signal processor 105, and sends data and destination or address data to the FIFO in machine language format (16-bit F data bytes and 8-bit destination data).

The system 100 draws a sequence of line segments to make up a given vector, defined by NVS, where N is a four-bit number defining the number of line segments comprising the vector, V is a one-bit number indicating video (Z channel) "on" or off, and S is a three-bit number defining one of eight directions. The entire symbol is sized (or scaled) by length $L_o$ and can be rotated.

The N, V and S data is supplied as F data via the FIFO 120 to the various registers and counters comprising the system 100, as will be described more fully below.

Thus, the system circuits receive F data and its corresponding destination address (when N=0). Many instructions load registers or counters of the system 100.

The DRAW ENABLE instruction loads N into the N counter 245, V into the V register 136, and S into the S register 122 or counter (FIG. 15), and the system 100 then goes through a sequence of hardware operations (as long as N>0) which draws a line or arc (N)(L)(dR) in length on the CRT display.

In another drawing mode for drawing fractional length lines, N and L are set to 1, so the line segment length is the programmable value dR, whereby a fractional line length (.L) less than one pixel length can be drawn.

The processor 105 may take the form of a commercially available digital signal processor device, such as the ADSP-2100 device available from Analog Devices, Inc. The controller 105 is connected to peripheral memory devices 110 and 115 and to first-in-first-out buffer (FIFO) 120. The processor 105 provides data in a serial fashion to the FIFO 120 which is clocked into the FIFO at a first clock rate CLK1 and which is clocked out of the FIFO at a second clock rate CLK2.

The integrating vector generator 130 is shown in more detail in FIG. 4, and is similar to the generator described above with respect to FIG. 1, except that the angle accumulator of FIG. 1 is external to the generator circuit 130. Circuit 130 comprises a coordinate transformation circuit which takes polar coordinates dR and angle (A+B) and converts them into cartesian coordinates dX and dY, which in turn are integrated (accumulated) to become. X and Y. The generator 130 receives setup or initializing data from the FIFO 120 and other data, including angle (A+B) and dR data (line segment step size) from other elements of the system, as will be described below.

The generator 130 provides X and Y position signals in digital form, which are converted to analog form by digital-to-analog converters 140 and 150. The resulting analog signals drive the deflection amplifiers 155 and 165, whose outputs in turn drive the X and Y deflection coils of the CRT. The generator 130 also provides a Z axis signal (dR) used to control the CRT beam intensity. The Z axis signal is passed through a Z axis processor 135, in the conventional manner, to provide such functions as windows, inclusion, exclusion, dot-dash, colors, brightness and blinking. Preferably, the system further comprises a Z axis or video compensation circuit 160, which compensates video signal for the delayed response characteristics inherent in the X and Y deflection circuitry. The circuit 160 is described more fully in U.S. Pat. No. 5.047,756 entitled "Video Compensation Apparatus for Stroke Mode CRT Displays," by the inventor hereof and commonly assigned with the present application.

Figure 5:
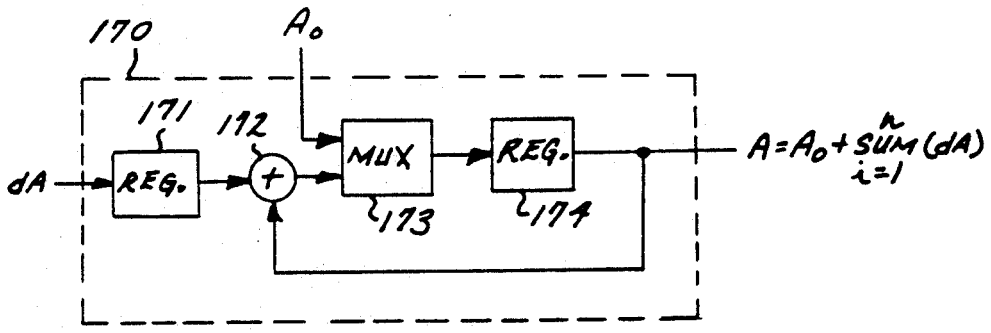
FIG. 5 illustrates the arc raster circuit comprising the system of FIG. 3.

The angle data A is provided by arc raster circuit 170, described below with respect to FIG. 5. The angle data A is summed with angle data B by summer 260. The angle data B is provided by one of the circuits 175, 180, 185, 190, 195, or 200, depending on the type of symbol or raster generating mode selected by the controller 105. The dR data is provided to the generator 130 by one of the circuits 175, 180, 185, 190, 195, 200 or 230, again depending on the type of symbol or raster generating mode selected by the controller 105. In addition, the integrating vector generator 130 receives data from circuits 205 and 210, to be used to generated lines from two defined end points, and to cause the selected symbol or raster to drift, respectively.

The system 100 therefore provides the capability of generating, through a single system, any one of a set of raster display types, or to generate a selected type of symbol or character, or to size a particular symbol or character as desired, or cause the generated symbol or character to drift. The F data from the FIFO 120 is steered to the appropriate circuit by the eight bit destination address byte also from the FIFO 120. In the conventional manner, the destination byte is decoded and the appropriate circuitry enabled, so that the F data is utilized by the desired one(s) of the symbol/raster generating circuits.

Integrating Vector Generator 130

Figure 4A:
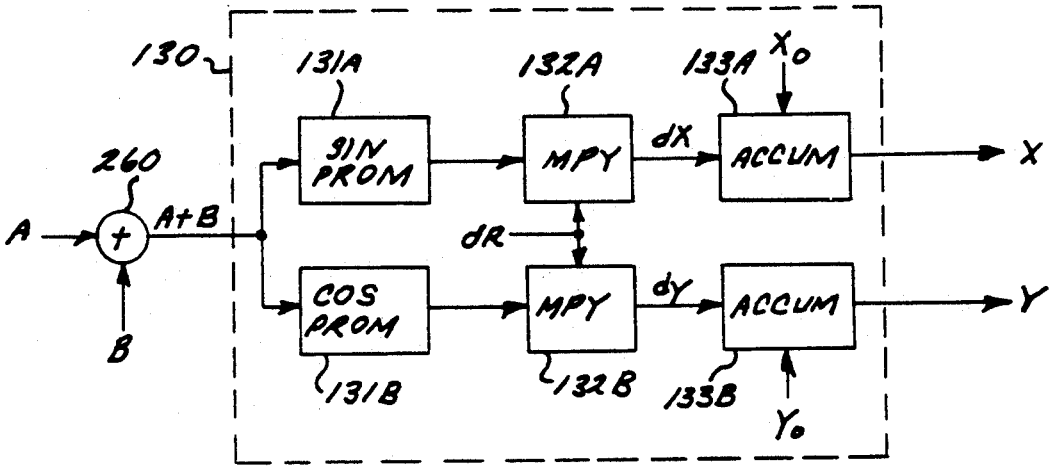
FIGS. 4A and 4B illustrate the integrating vector generator comprising the system of FIG. 3.
Figure 4B:
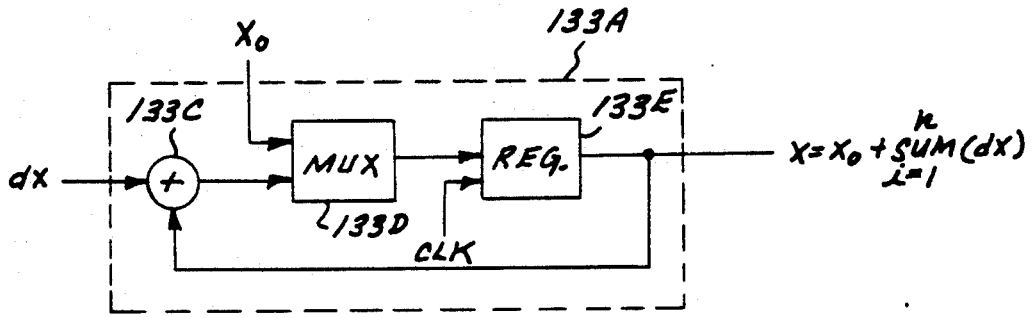

The integrating vector generator 130 is shown in more detail in FIGS. 4A and 4B. As discussed above with respect to FIG. 1, the generator accepts an angle (A+B), step size dR, positions $X_o$ and $Y_o$, and provides two outputs, X and Y. The inputs dR and (A+B) can vary with every clock period or pulse or raster line pulse (horizontal line retrace). The outputs X and Y are defined by the relationships of eqs. 1 and 2.

$$X = X_o + \text{sum } (i=1 \text{ to } n) dX \quad (1)$$

$$Y = Y_o + \text{sum } (i=1 \text{ to } n) dY \quad (2)$$

The outputs X and Y are destined to provide horizontal and vertical drive signals to deflection plates of a CRT or to a display memory for later display to a CRT.

The generator 130 comprise cosine PROM 131A and sine PROM 131B which respectively provide the corresponding cosine and sine values of the angle value (A+B) and supply these cosine and sine values to the X and Y multipliers 132A and 132B, for multiplication with the current value of dR to provide the cartesian coordinates dX and dY. These cartesian coordinates are then integrated by accumulators 133A and 133B to provide the output signals X and Y.

The X accumulator 133A is shown in more detail in FIG. 4B, and comprises a summing device 133C, multiplexer 133D and register 133E, which operate in a manner as described with respect to the accumulators described with respect to FIG. 1 to provide an accumulated value for X over n clock periods. The Y accumulator 133B is identical to the X accumulator 133A. The operation of both accumulators and the multipliers 132A and 132B is enabled by an active DRAW ENABLE pulse, generated by the line length counter circuit 230.

Arc Raster Circuit 170

The arc raster circuit 170 provides a means, together with the generator 130, for generating arc and linear rasters (see FIGS. 16A–E). Linear rasters are typically used to display ordinary television imagery, e.g., by a television receiver. Arc rasters are typically used to display radar information. To create an arc line with the system 100, it is only necessary to change the angle A every clock time while keeping dR constant. This is done with an accumulator as shown in FIG. 5.

The circuit 170 comprises a register 171 which receives F data from the FIFO 120 defining dA, i.e., the angle step size. The register 171 output is supplied to the accumulator comprising summing device 172, multiplexer 173 and register 174. The multiplexer 173 is used to provide an initial angle value $A_o$, also defined by F data. The accumulated angle value A is then equal to the initial value $A_o$ plus the sum of the dA values over n clock times. A complete arc raster is drawn by changing dR every line time after repositioning the beam (by changing $X_o$ and $Y_o$) for the start of the new line.

The operation of the accumulator comprising circuit 170 is enabled by the DRAW ENABLE pulse.

8-sided Symbols and Characters 175

Figure 6A:
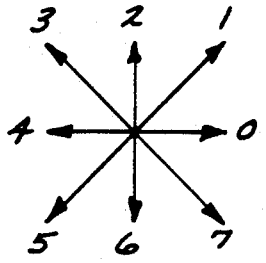
FIGS. 6A–6C illustrate the 8-sided symbol and character generator circuit comprising the system of FIG. 3.

Circuit 175 is used to generate a set of symbols and characters which are drawn by vectors oriented in eight possible directions. The directions are defined by the 3-bit code S. The eight possible vector directions are shown in FIG. 6A as vectors 0–7. The horizontal and vertical vectors 0, 2, 4, 6 are drawn with size (dR). The 45 degree directions 1, 3, 5, 7 are drawn with size dR times the square root of two.

Figure 6B:
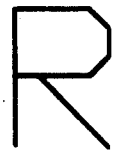
Figure 15:
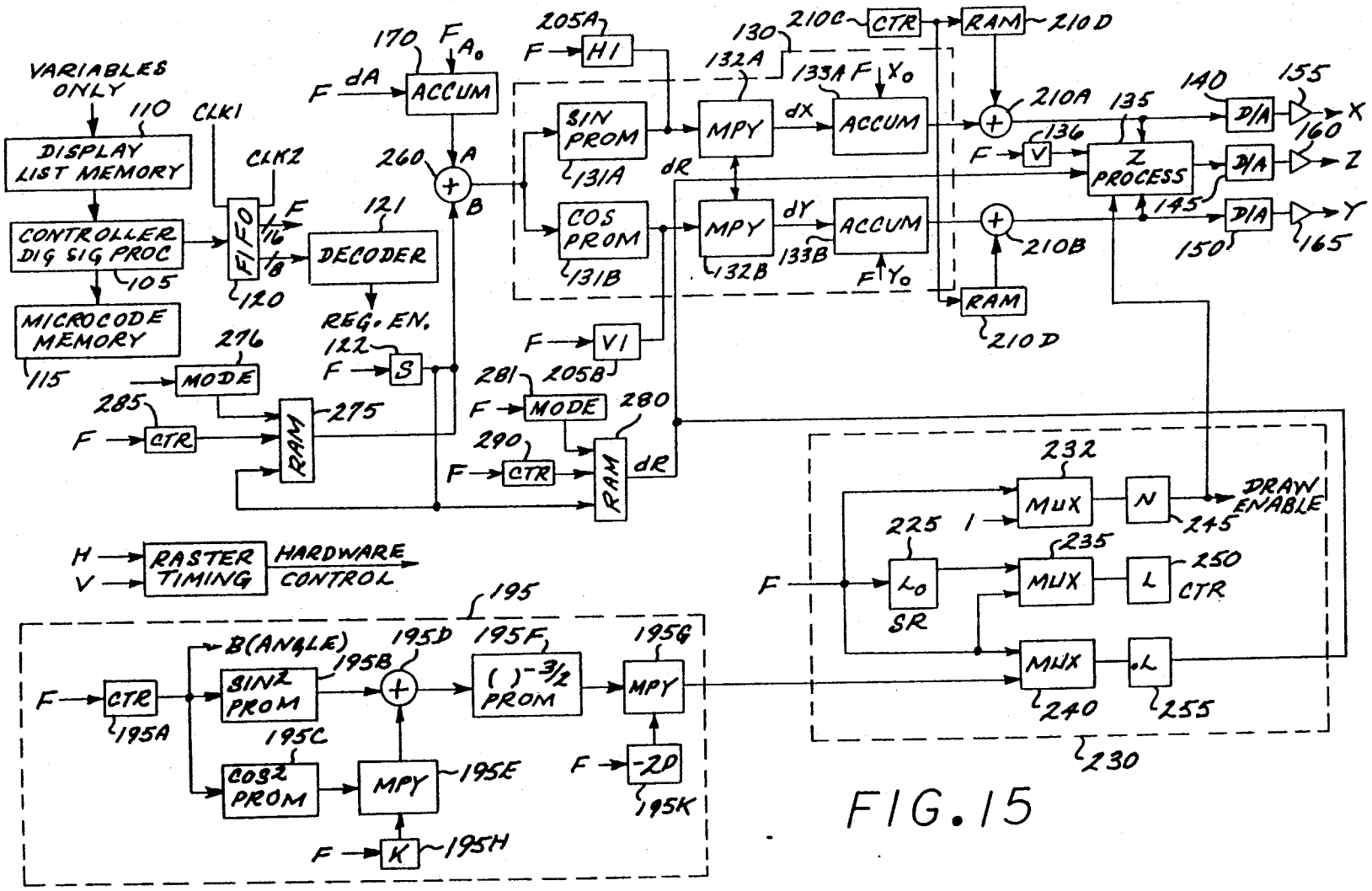
FIG. 15 is a schematic block diagram integrating the circuits illustrated in FIGS. 4–13 into the block diagram representation of FIG. 3.

An eight-bit code, N,V,S, together with a line length L, defines a vector of line length (dR)(N)(L) in the direction A+B, with video V (on or off). For example, the eight sided character R illustrated in FIG. 6B is drawn by use of the successive codes 6-1-2, 3-1-0, 1-1-7, 1-1-6, 1-1-5, 3-1-4, 1-0-0, 3-1-7, and 2-0-0. The codes are sent by the processor 105 via the FIFO 120. The values N and L are loaded into circuit 230 (FIG. 3). The value S is loaded into register 122 (FIG. 15).

Referring now to FIG. 3, the line length counter circuit 230 is used to determine the length (dR)(N)(L). The length dR is drawn (N)(L) times. An initial value $L_o$ is loaded into the L counter 250 from $L_o$ register 225 via multiplexer 235, and the value N is loaded into the N counter 245 via multiplexer 232. The "DRAW ENABLE" output of counter 245 is active while counter 250 counts from $L_o$ to one, N times. A programmable number of wait states is inserted between each segment to allow the CRT beam to settle.

Figure 6C:
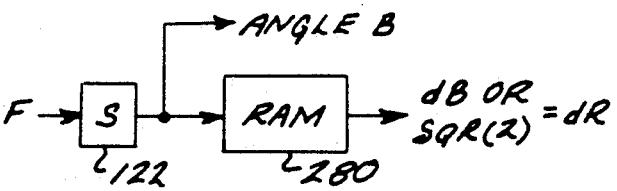

FIG. 6C illustrates the manner in which the line segment length for the 8-vector character set is generated from the angle S data. The three bit S code is used to address a lookup table stored in random access memory 280. Depending on the angle value, the RAM output is either dR or dR times the square root of 2.

Slanted Character Circuit 180

Figure 7A:
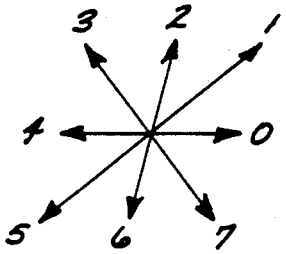
FIGS. 7A–7C illustrate the slanted character generator circuit comprising the system of FIG. 3.
Figure 7B:
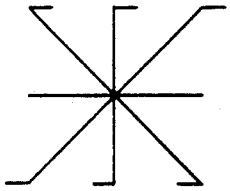
Figure 7C:
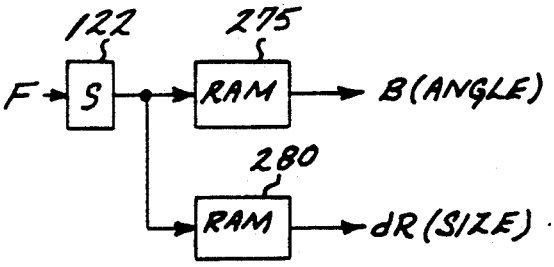

Slanted character generation is made possible by use of the same 8-bit code NVS used in the generator 175, and by redefining the size and directions of the vector represented by S to those illustrated in FIG. 7A, by adding a horizontal vector segment to each of the vectors of FIG. 6A, as indicated in FIG. 7B. The angles defined by NVS are modified, as well as the size dR. The modification is performed by a PROM or RAM. FIG. 7C illustrates the circuit 180, wherein the angle code S is used to address RAMS 275 and 280 to provide corresponding values of B (angle) and dR (size).

16-sided Character Circuit 185

Figure 8A:
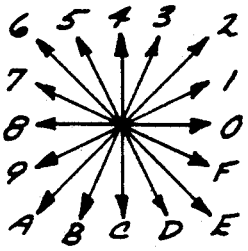
FIGS. 8A–8C illustrate the 16-sided character generator circuit comprising the system of FIG. 3.
Figure 8B:
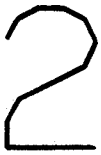
Figure 8C:
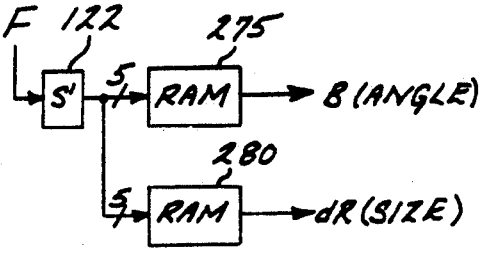

Characters drawn by use of a 16-vector set have a smoother appearance than characters drawn with an 8-vector set, and may be drawn using circuit 185. Characters drawn using 16 possible vectors are illustrated in FIG. 8A. The characters are drawn on a grid 8-line segments by 12-line segments in size. The exemplary 16-sided version of the number "2" drawn by use of the 16-vector set is shown in FIG. 8B. A four-bit code S′ is used to define the angles and sizes of the sixteen vectors by using the code S′ to address RAMS 275 and 280 to provide corresponding values of the angle B and step size dR, as shown in FIG. 8C.

The character "2" of FIG. 8B is drawn on an 8 by 12 grid with the following NVS codes: 9-0-4; 2-1-3; 2-1-1; 2-1-0; 2-1-F; 2-1-D; 2-1-B; 2-1-9; 2-1-8; 2-1-9; 2-1-B; 3-1-C; 8-1-0; 4-0-0.

Curved Character Circuit 190

Curved characters made of straight and curved lines can be defined on a five-by-eight grid using circuit 190. The straight lines are the vectors shown in FIG. 9A, which are the same as the vectors for the eight sided character and symbol circuit 175. The curved lines are the curved lines 8, 9, A, B, C, D, E, F as shown in FIG. 9B, and are for curves in the respective clockwise and counter-clockwise directions.

A four-bit code S″ defines the straight and curved lines, as well as the step size dR, by its use to address RAMS 275 and 280. The outputs of counters 285 and 290 are also used to define the RAM address, as shown in FIG. 9D. The counters 285 and 290 provides extra states for drawing the curves.

The curved lines shown in FIG. 9B represent 90° curves or quarter circles. In fact, the curved lines are made up of a sequence of short straight line segments, defining either a circumscribed or inscribed quarter circle, as depicted in FIG. 9E. A circumscribed representation has a smoother appearance when joined with straight line representations. If the number of sides or segments per circle (NS) is 16 (NS=16), five segments are required, i.e., ((NS/4)+1), to define a circumscribed quarter circle, with angle steps of 360/NS=360/16, and wherein the first and last segment lengths are one-half the length of the other three segments.

An inscribed quarter circle representation requires (NS/4)=4 segments of equal length. The angle step size is 360/NS 360/16. The angle of the first segment is (360/(2NS))=360/32 degrees.

For both the circumscribed and inscribed quarter circle representations, the segment lengths dR and the angle data for a particular quarter circle representation are stored in respective RAMS 280 and 275. The RAMS are addressed by the value S″ and the outputs of respective counters 285 and 290. The counter outputs provide the additional states (5 for circumscribed, 4 for inscribed) required to draw a quarter circle curved line with a single code from the processor 105. The counters 285 and 290 are reset to zero, and allowed to count to 4 for a circumscribed arc, or to 3 for an inscribed arc, whenever the F data code commands a quarter circle to be drawn.

By way of example, the curved numeral "2" of FIG. 9C can be drawn with the following NVS″ codes, with the S″ code representing the code values for the straight line segments 0–7 of FIG. 9A and the curve line segments 8, 9, A–F of FIG. 9B: 6-0-2; 1-1-E; 1-1-0; 1-1-F; 1-1-C; 1-1-4; 1-1-9; 2-1-6; 5-1-0; 3-0-0. The last code moves the beam into position to commence drawing the next character.

Conic Curve Circuit 195

Conic curves may be represented by second order equations, and consist of circles, ellipses, parabolas, and hyperbolas (see FIG. 10A). The following second order equation describes a general conic curve:

$$Y^2=4PX+KX^2 \quad (3)$$

It can be shown that $$dX=(dR)(\cos B) \quad (4)$$

$$dY=(dR)(\sin B) \quad (5)$$

$$dR/dA=-2P(\sin^2 B+K\cos^2 B)^{-3/2} \quad (6)$$

If K=1, a circle results (FIG. 10A). If $0<k<1$, an ellipse results (FIG. 10A). If $k<0$ a hyperbola results (FIG. 10A).

To draw conics in accordance with the above equations, a straight line segment dR is drawn for each incremental angle dB. dB is chosen to be 360°/64 or smaller. The values for $\sin^2 B$, $\cos^2 B$ and $(f(B))^{-3/2}$ are stored in PROM lookup tables. The size of the curve is determined by the parameter P. Values for dR can be calculated by the above equations and the look-up tables.

The circuit 195 implements eq. 6, and may be used to draw conic curves, and to concatenate any portion of any of these curves to draw smoothly curved symbols and graphics, given a few simple constants. The circuit 195 is shown in greater detail in FIG. 10B. The circuit 195 comprises a counter 195A which is loaded with F data from the FIFO 120. The counter 195A output state provides the angle B data, and also serves as the address for PROMs 195B and 195C, which serve as lookup tables to provide the $(\text{sine})^2$ and $(\text{cosine})^2$ values corresponding to the value of the angle B. The $\text{sine}^2$ value is provided to the summer 195D. The $\text{cosine}^2$ value is provided to multiplier 195E where it is multiplied by the parameter K (loaded via F data), and the product is summed at summer 195D with the $\text{sine}^2$ value. The sum (f(B)) is provided to PROM 195E to serve as the address for looking up the corresponding value of $(f(B))^{-3/2}$, i.e., to provide the value which corresponds to the $-3/2$ power of the address value. This value is then multiplied by P (loaded via F data), and the product serves as the L.L line length value, L to be loaded into L counter 250 and .L to be loaded into register 255 by way of multiplexers 235 and 240.

By way of example, the procedure for drawing an ellipse is the following. The PROMS 195B, 195C and 195F are programmed with data corresponding to 64 angles to cover 360°. The counter 195A is designed so that it counts every time the state of the N counter 245 changes. Register 56 is loaded with an $A_o$ value representing a global angle. Counter 195A is loaded with zero as the starting angle. The K register 195H is loaded with 0.5 (for an ellipse). The P register 195K with the exemplary size value 10. To draw the complete ellipse, load the code NVS with the 64-1-0.

Spiral Circuit 200

A spiral curve is a circle whose radius is gradually changing. It can be used to produce filled circles and special effects. The circuit 200 is shown in FIG. 11, and comprises a counter 285 and RAM 280. The counter 285 is loaded with F data from FIFO 120, and its output addresses RAM 280 to provide the corresponding value of dR for the counter state. For example, to create an inward spiral, as the counter is increased each clock time, the RAM output dR is decreased. At the same time, the angle A is increased by dA each clock time. To create an outward spiral, the RAM output dR is increased each clock time, with dA remaining constant.

End Points Line Circuit 205

The function of the circuit 205 is to draw a line between two defined end points, P1 and P2, as shown in FIG. 12A. To achieve this function, the integrating vector generator 130 is provided with additional circuitry as shown in FIG. 12B. A first shift register 205A is coupled to the X multiplier 132A (through a multiplexer or tri-state select not shown in FIG. 12B). Comparator circuits 205D and 205E provide active outputs when the two most significant bits of the states of the respective shift registers 205A and 205B are equal. The comparator outputs are connected to AND gate 205C, which provides an active SHIFT output which enables the register 205A and 205B to shift up by one stage, and the register 225 to shift down by one stage.

The function of drawing a line between two defined end points is carried out in the following manner. Two end points P1 and P2 are defined as (x1, y1) and (x2, y2). The vertical distance or length V1 between the points is y2−y1, and the horizontal distance H1 is x2−x1. To draw a line between P1 and P2, the line is started at point P1 by loading x1 and y1 into the X and Y accumulators 133A and 133B. The horizontal length (x2−x1) is loaded into shift register 205A, and the vertical length (y2−y1) is loaded into shift register 205B. The value $2^{10}$ is loaded into shift register 225, and the value $2^{-10}$ is provided as the value dR. $2^{10}=1024$, a typical number of pixels in the width or length of a CRT display, e.g., a 1024×1024 pixel screen.

A line will then be drawn from P1 to P2, in $L_o$ number of clock periods.

$$x2=x1+L_o*H1*dR$$

$$y2=y1+L_o*V1*dR$$

where $dR=\text{step size}=2^{-10}$.

The line from P1 to P2 can be relatively large, with the maximum value being full scale H1 and V1, or relatively small. If the vertical and horizontal lengths are small, the drawing of the line will require a relatively large number of clock periods and therefore a relatively long time. To draw the line in minimum time, $L_o$ should be minimized. If the line length is relatively small, then the drawing time can be reduced if the magnitudes of H1 and V1 are doubled and the number $L_o$ is halved.

To accomplish this, the registers 205A and 205B are shifted up and register 225 is shifted down until the state of either register 205A or 205B is more than half of full scale. (Shifting up by one stage doubles the state value, while shifting down by one stage halves the state value.) The length of the line is the same but drawn in shorter time.

To accomplish this, $L_o$ is set equal to $2^{10}$ and the values of H1, V1 are loaded into the shift registers 205A and 205B. If H1 and V1 are both less than ½ of full scale, then their sizes are doubled by shifting them up by one stage in the respective shift register, and $L_o$ is halved by shifting it down by one stage in register 225. This is repeated until the value of H1 or V1 is more than ½ of full scale or the value for $L_o=1$. Then the line is drawn.

The circuit detects the condition when the value Y1 and H1 are less than half of the full scale or maximum value in the following manner. The three most significant bits (H9, H8, H7) of a ten bit number have 8 possible values:

| Value | H9 | H8 | H7 |
|---|---|---|---|
| 3 | 0 | 1 | 1 |
| 2 | 0 | 1 | 0 |
| 1 | 0 | 0 | 1 |
| 0 | 0 | 0 | 0 |
| −1 | 1 | 1 | 1 |
| −2 | 1 | 1 | 0 |
| −3 | 1 | 0 | 1 |
| −4 | 1 | 0 | 0 |

The value of the 3 bit number is less than half of full scale if the 2 most significant bits (msb) (H9 and H8) are equal. So if the 2 msb of H1 and the 2 msb of V1 are equal and if $L_o > 1$, then registers 205A, 205B and 225 are shifted; otherwise the line is drawn. The same holds for a ten bit number.

The system 100 operates in the following manner to draw a straight line between two specified end points. The step size dR is initialized (e.g., to $2^{-10}$), and dA is set to zero. The coordinates $X_o$, $Y_o$ of the line start point are loaded into the respective registers comprising the accumulators 133A and 133B. The horizontal component length of the straight line is loaded into register 205A and the vertical component length of the straight line is loaded into register 205B. The line is drawn by loading 1-1-0 the NVS code. The registers 205A, 205B and 225 will shift as long as the signal SHIFT is true. When SHIFT becomes false, the line will be drawn until N=0.

The truth table for SHIFT, N and the circuit operation is given below:

| SHIFT | N > 0 | OPERATION |
|---|---|---|
| 0 | 0 | Next instruction |
| 0 | 1 | Draw line |
| 1 | 0 | Shift registers |
| 1 | 1 | Shift registers |

Drive Circuit 210

A drift effect of symbols and rasters can be accomplished with the system by adding the hardware shown in FIG. 13. The X and Y outputs of the integrating vector generator are fed to respective summing devices 210A and 210B to be summed with values from counter 210C-addressed RAM 210D. The symbol or raster will drift in accordance with the changing values from the RAM 210D.

Line Length Counter Circuit 230

Figure 14:
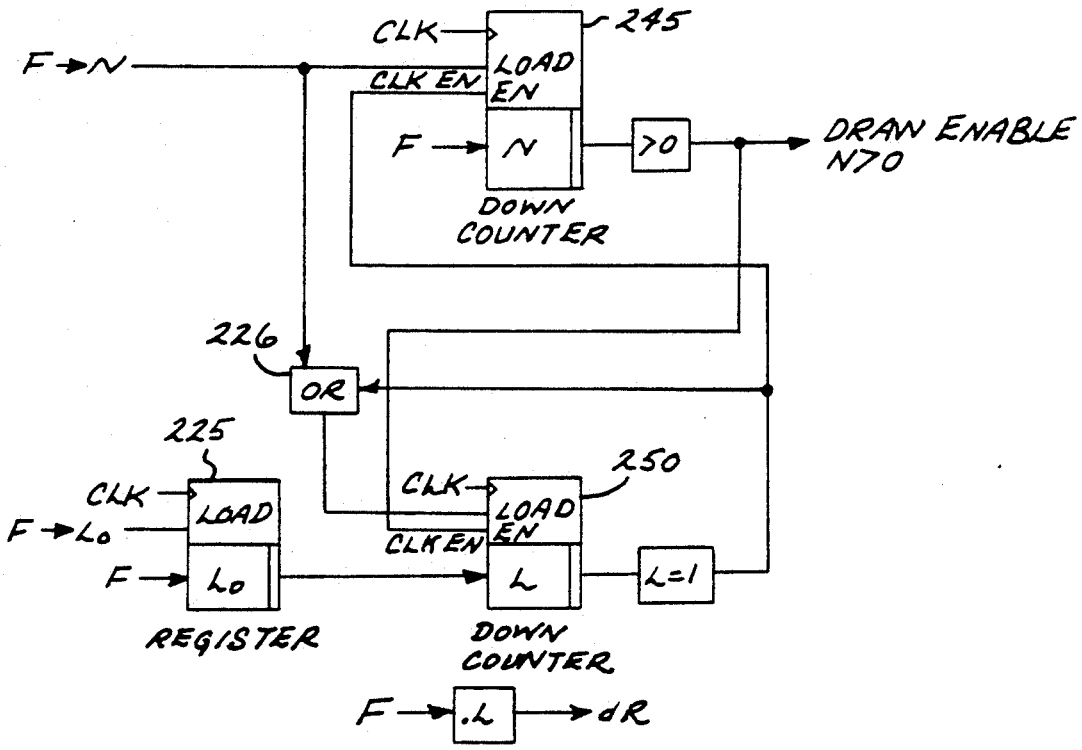
FIG. 14 illustrates the line length counter circuit comprising the system of FIG. 3.

The system 100 includes a line length counter circuit 230 which controls the length of the lines drawn on the CRT display. The circuit 230 is shown in essential detail in FIG. 14, omitting the multiplexers 232, 235 and 240, which are activated during the conic curve drawing mode to select the output from the conic curve circuit 195, but which otherwise selects the F data input. The circuit 230 comprises the Lo register 225, the N down counter 245, the L down counter 250 and the OR circuit 226, to produce a DRAW ENABLE signal, and a register 255 which loads the value dR from the F data.

The counter circuit 230 produces a DRAW ENABLE pulse which is (N)(L) clock periods in duration. The DRAW ENABLE pulse is used to enable the accumulators 170, 133A and 133B, the multipliers 132A, 132B and the Z processor 135. The video (Z channel) is blanked out, except when the DRAW ENABLE pulse is active.

The register 225 and the counters 245 and 250 are clocked by the clock signal, and are loaded with data from the F data bus. The counters 245 and 250 further receive clock enable signals. The clock enable signal of counter 250 is from an output of counter 245, active when the count state N is greater than zero. The output of the OR gate 226 serves as the load enable signal for the counter 250, and is active when either OR gate input is active. The inputs to the OR gate are the N load enable signal and the L=1 signal.

To illustrate the operation of the circuit 230, consider as an example the case wherein it is desired to produce a DRAW ENABLE pulse which is six clock periods in duration. In a first step, the value 3 is loaded into the $L_o$ counter 225. In the next step, the value 2 is loaded into the N counter 245, and the value 3 is loaded into the L counter 250 from the $L_o$ register 225, since the OR gate 226 output is active. The DRAW ENABLE pulse is active whenever the count value N of counter 245 is greater than zero. Hence, loading the value 2 into the N counter 245 starts the DRAW ENABLE pulse.

The first two steps and the next seven steps are illustrated in the following table, showing the respective values of $L_o$, N, L and the DRAW ENABLE pulse.

| $L_o$ | N | L | DRAW ENABLE |
|---|---|---|---|
| 3 | 0 | X | 0 |
| 3 | 2 | 3 | 1 |
| 3 | 2 | 2 | 1 |
| 3 | 2 | 1 | 1 |
| 3 | 1 | 3 | 1 |
| 3 | 1 | 2 | 1 |
| 3 | 1 | 1 | 1 |
| 3 | 0 | X | 0 |

Note that when the value in the L counter counts down to 1, the N counter 245 is clock enabled to decrement by 1, and the value 3 is reloaded, and the counter 255 restarted to the value 3 to count down to 1. Note that in Table 1, the DRAW ENABLE pulse is held active for 6 clock periods, the desired duration ($2 \times 3 = 6$).

The next code instruction is received when N=0.

System Schematic Block Diagram (FIG. 15)

FIG. 15 is a block diagram of the system 100, wherein functional circuit blocks of FIG. 3 have been replaced with the corresponding circuits described above with respect to FIGS. 4–13. All of the circuit elements of the system, except the processor 105, the memories 110, 115, and the FIFO 120, can be implemented as a gate array on one integrated circuit chip.

FIG. 15 illustrates the destination address decoder 121, which decodes the 8-bit destination address byte accompanying each F data byte to enable the appropriate register or device specified by the address byte. Such address decoding will be readily understood by those skilled in the art.

The system 100 can be operated in various modes to generate the selected one of the raster/symbols described above. Mode decoders 276 and 281 decode mode selection data comprising the F data bytes into RAM sector selection signals for activating or allowing access to the sector of RAMS 275 and 280 which stores data to be used in the selected mode of operation.

As shown in FIG. 15, the system 100 further includes conventional raster timing circuitry for generating hardware control signals. H and V are horizontal and vertical retrace pulses conventionally employed in raster-scanned television.

The system 100 is an integrated signal generator capable of providing X and Y deflection circuitry control signals to produce various types of rasters and vector-drawn symbols and characters. The following examples further demonstrate the capability of the system.

Arc Raster Example

An arc raster is formed in the following manner. During the vertical retrace time, the following parameters are initialized by sending appropriate F data and destination address data through the FIFO 120:

$$dA = dA_o$$
$$X_o = X_{oo}$$
$$Y_o = Y_{oo}$$
$$A_o = A_{oo}$$
$$dR_o = dR_{oo}$$

During each horizontal retrace time, the system is set up to draw the next line in the following manner:

$$X_o = X_o + dX_o$$
$$Y_o = Y_o + dY_o$$
$$X = X_o$$
$$Y = Y_o$$
$$A = A_o$$
$$dR = dR_o$$

During the horizontal active time, the arc is drawn in the following manner, for each clock.

$$X = X + dR \cos A$$
$$Y = Y + dR \sin A$$
$$A = A + dA$$

Thus, each line is drawn by adjusting the start point to a new start point, and the step size is modified by a value $ddR_o$. The controller need specify only the parameters dR, $A_o$, $ddR_o$, $X_o$, $Y_o$, $dX_o$, $dY_o$ and $dA_o$.

Other rasters are special cases of the generalized arc raster, and can be formed by calculating and setting the parameters given above.

Special Characters and Symbols

The special characters and symbols which may be drawn using the system 100 include 8-sided symbols and characters, 16-sided symbols and characters, slanted characters, curved characters, and conic curves and spirals. An efficient way to generate these symbols and characters is to establish, for each type of symbol or character, a set of characters or symbols, and to store the NVS and destination address codes required to generate each symbol or character comprising each set. In one exemplary arrangement of system 100, these codes can generally be stored in the display list memory 110, and can be addressed by the processor 135 as a look-up table, with a predetermined address code for each symbol or character being used to address the memory 110.

End Point Line Generation

Selection of the end point line generation mode requires the integrating vector generator 130 be reconfigured as shown in FIG. 12B, that the line start point coordinates $X_o$ and $Y_o$ be provided as F data to accumulators 133A and 133B, that the horizontal and vertical component lengths of the line be provided to shift registers 205A and 205B, and that appropriate values for dR, N and $L_o$ be provided to the line length counter circuit 230.

Symbol/Character Drift Effect

Circuit 205 provides the capability of creating a drift effect, whereby symbols, characters or raster drift across the CRT display. The speed and direction of the drift is controlled by the X and Y drift values supplied to adders 210A and 210B from RAM 210D. Thus, desired effects can be characterized by the incremental change between the X and Y drift values from one clock interval to the next, with the particular values stored in look-up tables stored in RAM 210D. Thus, the drift values may change by some linear or non-linear function, thereby creating a desired drifting of the CRT imagery on the CRT screen.

It is understood that the above-described embodiments are merely illustrative of the possible specific embodiments which may represent principles of the present invention. Other arrangements may readily be devised in accordance with these principles by those skilled in the art without departing from the scope of the invention.

What is claimed is:

1. A multiple function digital signal generator for generating CRT display beam position signals, comprising:

a controller for providing sequential digital control bytes defining a sequence of line segments to make up a given vector, said control bytes comprising a data word and a destination address word to define the destination circuitry for converting said data word into polar coordinate data;

first destination circuitry comprising angle accumulating means responsive only to data words directed to said first circuitry by said address word for accumulating polar coordinate angle data dA and an initial angle value $A_O$ over a selected time interval to provide an accumulated angle value A;

means for summing said accumulate angle value A with another angle value B to provide a polar coordinate angle value;

a second destination circuitry responsive to data words directed to said second circuitry and comprising an integrating vector generator responsive to said polar coordinate angle value for providing X and Y position signals in digital form, and a Z axis beam intensity signal, said generator comprising coordinate transformation means for transforming polar coordinate data comprising said polar coordinate angle value and a step size dR into cartesian coordinates dX and dY, and for integrating said cartesian coordinate data into said X and Y position signals; and a third destination circuitry responsive only to data words directed thereto by a destination address word identifying said third destination circuitry, said circuitry comprising means for converting said data word into corresponding polar coordinate data comprising an angle value B and a step size dR required for generating a second type of CRT imagery, said angle value B for input to said summing means and said step size dR for input to said integrating vector generator, and wherein said signal generator is capable of generating an arc raster line as a first CRT imagery type by drawing a series of vectors, each of step size dR, and wherein the angle between adjacent vectors changes by dA, said values dA and dR being selected by data words provided by said controller, and wherein said signal generator is further capable of selectively generating said second type of CRT imagery by directing appropriate data words to said third destination circuitry, by use of a single integrating vector generator.

2. The signal generator of claim 1 wherein said first destination circuitry and said summing means comprises means for converting a data word representing the angle step size dA and initial angle $A_O$ into polar coordinate data comprising an accumulated angle value A equal to the initial value $A_O$ plus the sum of the dA value over n clock times.

3. The signal generator of claim 1 wherein said third destination circuitry comprises a circuit for generating a set of 8-sided symbols and characters, said circuit comprising means for converting a data word directed to said circuitry defining the line length, direction and Z-axis signal value int polar coordinate data representative of particular vectors defining said respective 8-sided symbol or character.

4. The signal generator of claim 3 wherein said 8-sided symbols are formed from an 8-vector set, wherein the vectors are oriented in 8 different directions, and the symbols are characters of the symbol and character set are defined by vector data defining a sequence of vectors comprising said vector set, said third destination circuitry comprising:

digital memory means storing the vector data defining each symbol and character defining the set, said memory means addressable to read the vector data defining said particular symbol or character; and means responsive to said vector data for providing angle data B and length data dR defining each vector.

5. The signal generator of claim 1 wherein said third destination circuitry comprises a slanted character circuit for generating a slanted character set, said circuit comprising means for converting a data word directed to said circuitry into polar coordinate data defining respective vectors comprising a selected one of said slanted characters.

6. The signal generator of claim 5 wherein the characters of said slanted character set are defined by vector data defining a sequence of vectors, said third destination circuitry comprising:

digital memory means storing the vector data defining each character defining the set, said memory means addressable to read the vector data defining said particular symbol or character; and means responsive to said vector data for providing angle data B and length data dR defining each vector.

7. The signal generator of claim 1 wherein said third destination circuitry comprises a circuit for generating a set of 16-sided symbols and characters, said circuit comprising means for converting a data word directed to said circuitry into polar coordinate data defining respective vectors comprising a selected one of said 16-sided symbols and characters.

8. The signal generator of claim 7 wherein said symbol and character set is formed from a 16-bit vector set wherein the respective vectors are oriented in 16 possible direction, and the symbols and characters of the symbol/character set are defined by vector data defining a sequence of vectors comprising said vector set, said third destination circuitry comprising:

digital memory means storing the vector data defining each symbol and character defining the set, said memory means addressable to read the vector data defining said particular symbol or character; and means responsive to said vector data for providing angle data B and length data dR defining each vector.

9. The signal generator of claim 1 wherein said third destination circuitry comprises a circuit for generating a set of curved characters, said circuit comprising means for converting a data word directed to said circuitry into polar coordinate data defining respective curved vectors comprising a selected one of said curved characters.

10. The signal generator of claim 9 wherein the characters comprising said set are defined by straight line segments oriented in eight possible directions and a set of simulated quarter-circles.

11. The signal generator of claim 1 wherein said third destination circuitry comprises a circuit for generating conic curves, said circuitry comprising means responsive only to data words directed to said circuitry by said respective address words to convert said data word into polar coordinate data defining a desired conic curve.

12. The signal generator of claim 11 wherein said circuit for generating conic curves comprises means for generating a connected sequence of vector segments, said means comprising:

means for generating a sequence of digital signals representing the relative angular orientation B of each vector segment;

means for generating a corresponding vector segment length dR for each vector segment, said means comprising means for determining dR in accordance with the relationship $$dR = -2P(\sin^2 B + K\cos^2 B)^{-3/2},$$

and K and P are programmable parameters whose values determine the type and size of the particular conic curve being generated, wherein a circular curve is drawn if K=1, a parabolic curve is drawn if K=0, a hyperbolic curve is drawn if K is less than zero, and an elliptical curve is drawn if K is greater than zero but less than one.

13. The signal generator of claim 1 wherein said third destination circuitry comprises means for generating a spiral curve, said spiral generating circuitry comprising means responsive only to data words directed to said circuitry by said respective address words to convert said data word into polar coordinate data defining said desired spiral curve.

14. The signal generator of claim 1 wherein said third destination circuitry comprises means responsive only to data words directed to said circuitry by said respective address words which define only respective line end points to generate polar coordinate data defining a line drawn between said end points.

15. The signal generator of claim 1 wherein said third destination circuitry comprises means responsive only to data words directed to said circuitry by said respective address words to generate polar coordinate data causing CRT imagery to appear to drift.

* * * * *